US009180704B2

(12) United States Patent
Ota et al.

(10) Patent No.: US 9,180,704 B2
(45) Date of Patent: Nov. 10, 2015

(54) IMAGE RECORDING APPARATUS

(71) Applicant: BROTHER KOGYO KABUSHIKI KAISHA, Nagoya-shi, Aichi-ken (JP)

(72) Inventors: Yasuhira Ota, Yatomi (JP); Noriyuki Kawamata, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/667,980

(22) Filed: Mar. 25, 2015

(65) Prior Publication Data

US 2015/0273902 A1 Oct. 1, 2015

(30) Foreign Application Priority Data

Mar. 31, 2014 (JP) ..... 2014-073834

(51) Int. Cl.

| | |
|---|---|
| ***B41J 13/00*** | (2006.01) |
| ***B41J 13/16*** | (2006.01) |
| ***B41J 13/10*** | (2006.01) |
| ***B41J 13/03*** | (2006.01) |

(52) U.S. Cl.

CPC *B41J 13/16* (2013.01); *B41J 13/03* (2013.01); *B41J 13/103* (2013.01); *B41J 13/10* (2013.01)

(58) Field of Classification Search

USPC ..... 347/104, 218

See application file for complete search history.

(56) References Cited

U.S. PATENT DOCUMENTS

| | | | | |
|---|---|---|---|---|
| 7,997,676 | B2 * | 8/2011 | Kawamata et al. | 347/16 |
| 8,092,004 | B2 * | 1/2012 | Uchino et al. | 347/104 |
| 2009/0085949 | A1 * | 4/2009 | Sugiyama et al. | 347/16 |
| 2010/0080639 | A1 * | 4/2010 | Matsushima | 399/371 |
| 2010/0207321 | A1 * | 8/2010 | Samoto et al. | 271/225 |
| 2011/0103867 | A1 * | 5/2011 | Iijima | 400/583 |
| 2013/0135411 | A1 * | 5/2013 | Ito et al. | 347/104 |
| 2013/0277170 | A1 * | 10/2013 | Samoto et al. | 198/367 |
| 2013/0278654 | A1 * | 10/2013 | Ito et al. | 347/6 |
| 2014/0035985 | A1 * | 2/2014 | Arakane et al. | 347/16 |

FOREIGN PATENT DOCUMENTS

| | | | |
|---|---|---|---|
| JP | 2007-182316 | A | 7/2007 |
| JP | 2010-083636 | A | 4/2010 |
| JP | 2013-164537 | A | 8/2013 |
| JP | 2013-184754 | A | 9/2013 |

* cited by examiner

*Primary Examiner* — Huan Tran

(74) *Attorney, Agent, or Firm* — Merchant & Gould PC

(57) ABSTRACT

An image recording apparatus includes: a housing having a sheet conveyance path having curved and extending portions; and a pivotable guide member at least partly defining the curved portion and pivotable. The guide member has a first guide portion and a second guide portion pivotably coupled to it. The first guide portion is pivotable between a first position for partly defining the curved portion and a second position where the curved portion is open. The second guide portion is movable between a third position where the second guide portion partly defines the curved portion with the first guide portion located at the first position and a fourth position where the second guide portion extends in a direction from an inner side to the outer side of the curved portion with the first guide portion located at the second position.

14 Claims, 8 Drawing Sheets

IMAGE RECORDING APPARATUS

CROSS REFERENCE TO RELATED APPLICATION

The present application claims priority from Japanese Patent Application No. 2014-073834, which was filed on Mar. 31, 2014, the disclosure of which is herein incorporated by reference in its entirety.

BACKGROUND

1. Technical Field

The present invention relates to an image recording apparatus configured to convey a sheet along a conveyance path and record an image on the sheet.

2. Description of the Related Art

There is known an image recording apparatus including a housing in which a conveyance path is defined, and an image is recorded on a sheet conveyed along the conveyance path. For reduced size of the image recording apparatus, the conveyance path is often curved in the housing. To perform maintenance and clear paper jam in the conveyance path, for example, the housing has an opening through which the conveyance path is accessible by a user. The opening can be opened and closed by a cover. The cover is pivotably supported by the housing to prevent loss or other similar problems.

SUMMARY

In a construction in which a plurality of the covers are provided on the conveyance path at a plurality of positions, in the event of, e.g., paper jam, the user needs to be notified of covers to be opened. Accordingly, the number of covers to be opened and closed by the user is preferably as small as possible. On the other hand, in a construction in which most portion of the conveyance path is opened by opening of one cover, a larger cover needs to be provided, which may result in a layout in which the pivoted cover overlaps a path through which the user accesses the conveyance path. This construction may make it difficult for the user to access the conveyance path or visually recognize the conveyance path.

Accordingly, an object of the disclosure is to provide an image recording apparatus including a cover pivotable to open a conveyance path and allowing a user to easily access the opened conveyance path.

In one aspect of the disclosure, an image recording apparatus includes: a housing formed with a conveyance path including (i) a curved portion curved upward and (ii) an extending portion continuous to the curved portion; a recording device configured to record an image on a sheet conveyed in a conveying direction along the extending portion of the conveyance path; and a guide member disposed on the conveyance path at a position located upstream of the recording device in the conveying direction, the guide member defining at least a portion of an outer side of the curved portion of the conveyance path, the guide member being pivotable in a state in which an upstream end portion of the guide member in the conveying direction serves as an axis, and a downstream end portion of the guide member in the conveying direction serves as a pivotal-movement distal end. The guide member includes a first guide portion and a second guide portion. The first guide portion is nearer to the axis than the second guide portion. The second guide portion is nearer to the pivotal-movement distal end than the first guide portion. The first guide portion is pivotable between (i) a first position at which the first guide portion defines a portion of the curved portion and (ii) a second position at which the curved portion is open. The second guide portion is pivotably coupled to the first guide portion and movable between (i) a third position at which the second guide portion defines a portion of the curved portion when the first guide portion is located at the first position and (ii) a fourth position at which when the first guide portion is located at the second position, the second guide portion extends in a direction directed from an inner side to the outer side of the curved portion defined by the first guide portion.

In another aspect of the disclosure, an image recording apparatus includes: a housing formed with a conveyance path including (i) a curved portion curved upward and (ii) an extending portion continuous to the curved portion; a recording device configured to record an image on a sheet conveyed in a conveying direction along the extending portion of the conveyance path; and a guide member disposed on the conveyance path at a position located upstream of the recording device in the conveying direction, the guide member defining at least a portion of an outer side of the curved portion of the conveyance path. The guide member includes: a first guide portion pivotable about a first axis relative to the housing; and a second guide portion pivotable about a second axis relative to the first guide portion. The first guide portion is pivotable between (i) a first position at which the first guide portion defines a portion of the curved portion and (ii) a second position at which the curved portion is open. The second guide portion is pivotable between an upper position and a lower position located on a lower side of the upper position, when the first guide portion is located at the second position.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Hereinafter, there will be described one embodiment by reference to the drawings. It is to be understood that the following embodiment is described only by way of example, and the disclosure may be otherwise embodied with various modifications without departing from the scope and spirit of the disclosure. A multi-function peripheral (MFP) 10 is used in a state illustrated in FIG. 1. In the present embodiment, three arrows illustrated in FIG. 1 indicate an up and down direction 7, a front and rear direction 8, and a right and left direction 9. In the following explanation, the up and down direction 7 is defined as an up and down direction of the MFP 10 illustrated in FIG. 1, i.e., the MFP 10 being in a normal state. Also, the front and rear direction 8 is defined by regarding a side of the MFP 10 on which an opening 13 is formed as a front side, and the right and left direction 9 is defined in a state in which the MFP 10 is viewed from the front side.

Overall Configuration of MFP 10

Figure 1:
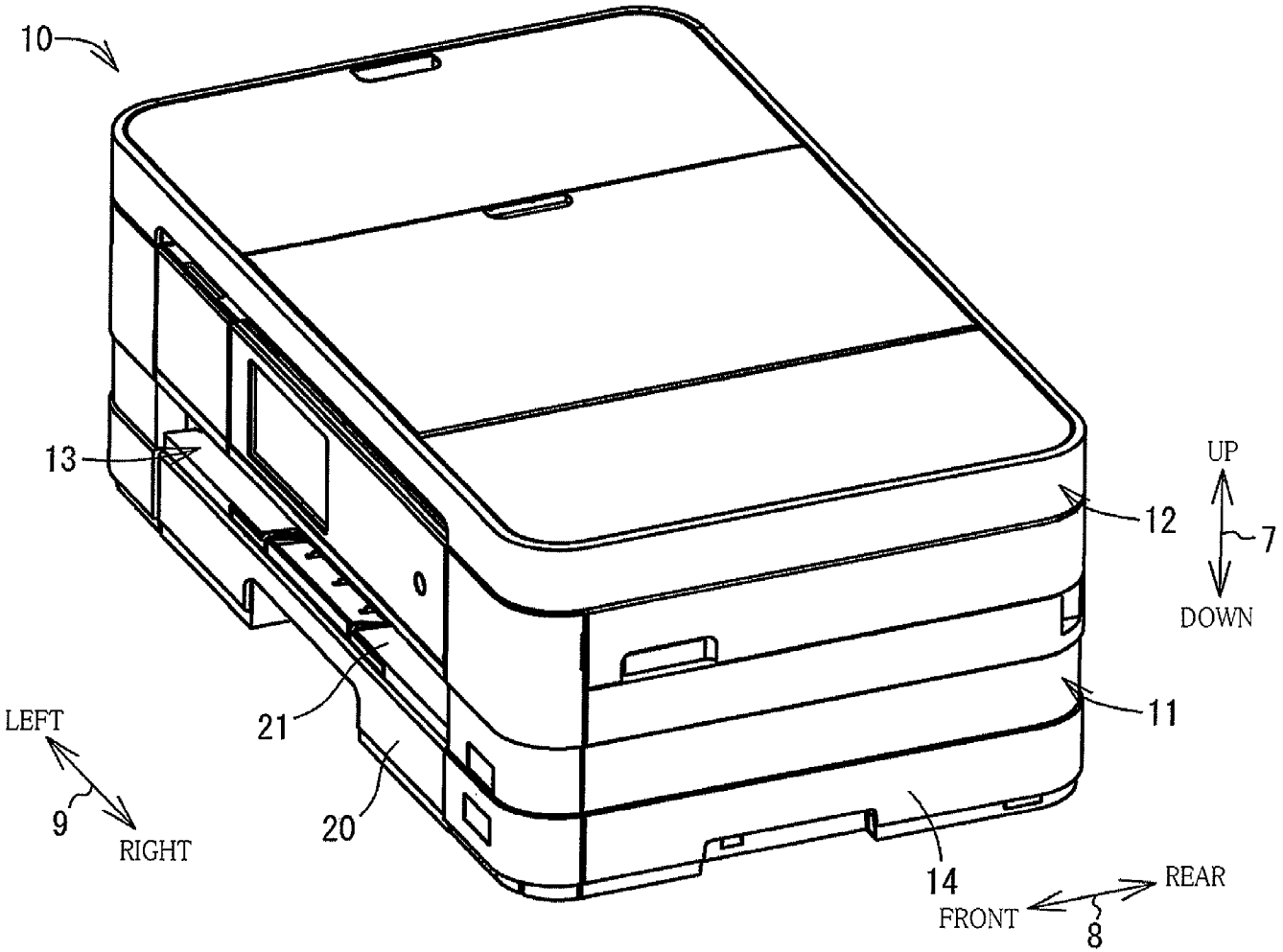
FIG. 1 is a perspective view illustrating a multi-function peripheral (MFP) according to one embodiment.

As illustrated in FIG. 1, the MFP 10 includes a housing 14 having a generally rectangular parallelepiped shape. The MFP 10 has various functions such as a facsimile function and a printing function.

A scanning unit 12 is provided in an upper portion of the housing 14. The scanning unit 12 is constituted as what is called a flatbed scanner, and a detailed explanation of an internal structure of the scanning unit 12 is omitted.

A printing unit 11 (as one example of an image recording apparatus) is provided in a lower portion of the housing 14. The printing unit 11 has an ink-jet printing function for recording an image on a recording sheet. Devices and components provided in the housing 14 include a supply tray 20, a supply device 16, a conveyance path 65, a recording device 24, roller pairs 59, 44, guide members 18, 19, 31, a roller holder 85, and contact members 41.

Supply Tray 20

As illustrated in FIG. 1, the opening 13 is formed in a front portion of the printing unit 11. The supply tray 20 (as one example of a tray) can be inserted and removed into and from the printing unit 11 in the front and rear direction 8 through the opening 13. The supply tray 20 is disposed in the lower portion (i.e., a bottom portion) of the housing 14 in the state in which the supply tray 20 is mounted in the printing unit 11. The supply tray 20 is shaped like a box opening upward. A multiplicity of recording sheets can be stacked on a bottom plate 22 of the supply tray 20 (see FIG. 2).

As illustrated in FIG. 1, an output tray 21 is provided over the supply tray 20. The output tray 21 is moved in the front and rear direction 8 together with the supply tray 20. The recording sheet printed by the recording device 24 is discharged onto an upper surface of the output tray 21.

Supply Device 16

Figure 2:
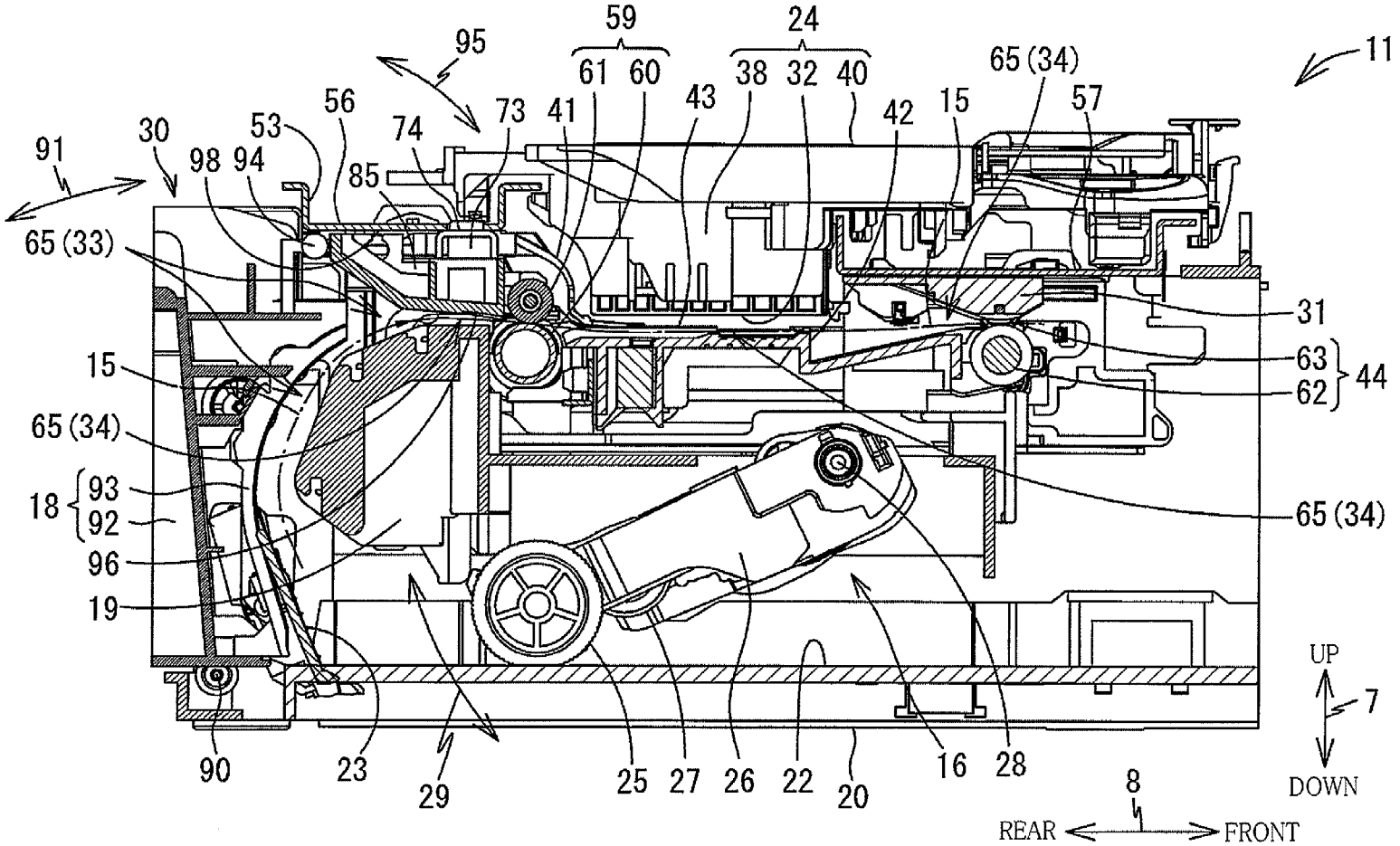
FIG. 2 is an elevational view in vertical cross section illustrating an internal structure of a printing unit, with an outer guide member located at a first position and a roller holder located at a third position.

As illustrated in FIG. 2, the supply device 16 is provided under the recording device 24 and over the supply tray 20 fitted in the printing unit 11. The supply device 16 includes a supply roller 25, a supply arm 26, and a driving-force transmission mechanism 27. The supply roller 25 is supported by a shaft provided at a distal end portion of the supply arm 26. The supply arm 26 is pivoted about a support shaft 28 provided on a basal end portion thereof in a direction indicated by the arrow 29. This construction allows the supply roller 25 to be moved toward and away from the supply tray 20 or a recording sheet supported by the supply tray 20.

The supply roller 25 is rotated by a driving force which is generated by a motor, not shown, and transmitted by the driving-force transmission mechanism 27 including a plurality of gears meshed with each other. As a result, an uppermost one of the recording sheets supported on the bottom plate 22 is supplied along the conveyance path 65. It is noted that the constituent element of the driving-force transmission mechanism 27 is not limited to the plurality of gears and may be a belt looped over the support shaft 28 and a shaft of the supply roller 25, for example.

Conveyance Path 65

As illustrated in FIG. 2, the conveyance path 65 extends from a rear edge portion of the supply tray 20. The conveyance path 65 includes a curved portion 33 and an extending portion 34. The curved portion 33 is curved upward and frontward from the rear edge portion of the supply tray 20. The extending portion 34 is continuous to an upper end of the curved portion 33 and extends in the front and rear direction 8.

The curved portion 33 is defined by the outer guide member 18 (as one example of a first guide member), the roller holder 85 (as one example of a second guide member), an inclined plate 23, and an inner guide member 19. The outer guide member 18, the roller holder 85, and the inclined plate 23 are opposed to and spaced apart from the inner guide member 19. The extending portion 34 is defined by the roller holder 85, the recording device 24, an upper guide member 31, the inner guide member 19, and a platen 42. In other words, the roller holder 85 defines at least a portion of the curved portion 33 and the extending portion 34. It is noted that the roller holder 85 may define at least a portion of only one of the curved portion 33 and the extending portion 34.

The recording sheet supported by the supply tray 20 is supplied by the supply roller 25 toward the inclined plate 23. Contact of the recording sheet with the inclined plate 23 changes a direction of travel of the recording sheet to the up direction, so that the recording sheet is supplied into the curved portion 33. The recording sheet supplied into the curved portion 33 is conveyed from a lower end to an upper end of the curved portion 33 and then to the conveying roller pair 59. The recording sheet nipped by the conveying roller pair 59 is conveyed in the front and rear direction 8 through the extending portion 34 toward the recording device 24. Under the recording device 24, the recording device 24 records an image on the conveyed recording sheet. The recording sheet on which the image has been recorded is conveyed further in the front and rear direction 8 through the extending portion 34 and discharged onto the output tray 21. As thus described, the recording sheet is conveyed in a conveying direction 15 indicated by the one-dot chain line arrow in FIG. 2.

Recording Device 24

As illustrated in FIG. 2, the recording device 24 is provided on an upper side of the extending portion 34. The platen 42 is provided under the recording device 24 so as to be opposed to the recording device 24. The platen 42 is provided with a plurality of ribs 43 standing upright on an upper surface of the platen 42 and extending in the front and rear direction 8. The ribs 43 are spaced apart from each other in the right and left direction 9. The ribs 43 support the recording sheet conveyed through the extending portion 34 of the conveyance path 65.

The recording device 24 includes a carriage 40 and a recording head 38. The carriage 40 is supported by guide rails 56, 57 so as to be reciprocable in the right and left direction 9. These guide rails 56, 57 are spaced apart from each other in the front and rear direction 8. The recording head 38 is mounted on the carriage 40. Ink is supplied from an ink cartridge, not shown, to the recording head 38. A lower surface 32 of the recording head 38 has a multiplicity of nozzles, not shown. During movement of the carriage 40 in the right and left direction 9, the recording head 38 ejects ink droplets from the nozzles toward the platen 42. As a result, an image is formed on the recording sheet conveyed along the extending portion 34 and supported on the platen 42.

Contact Members 41

Figure 3:
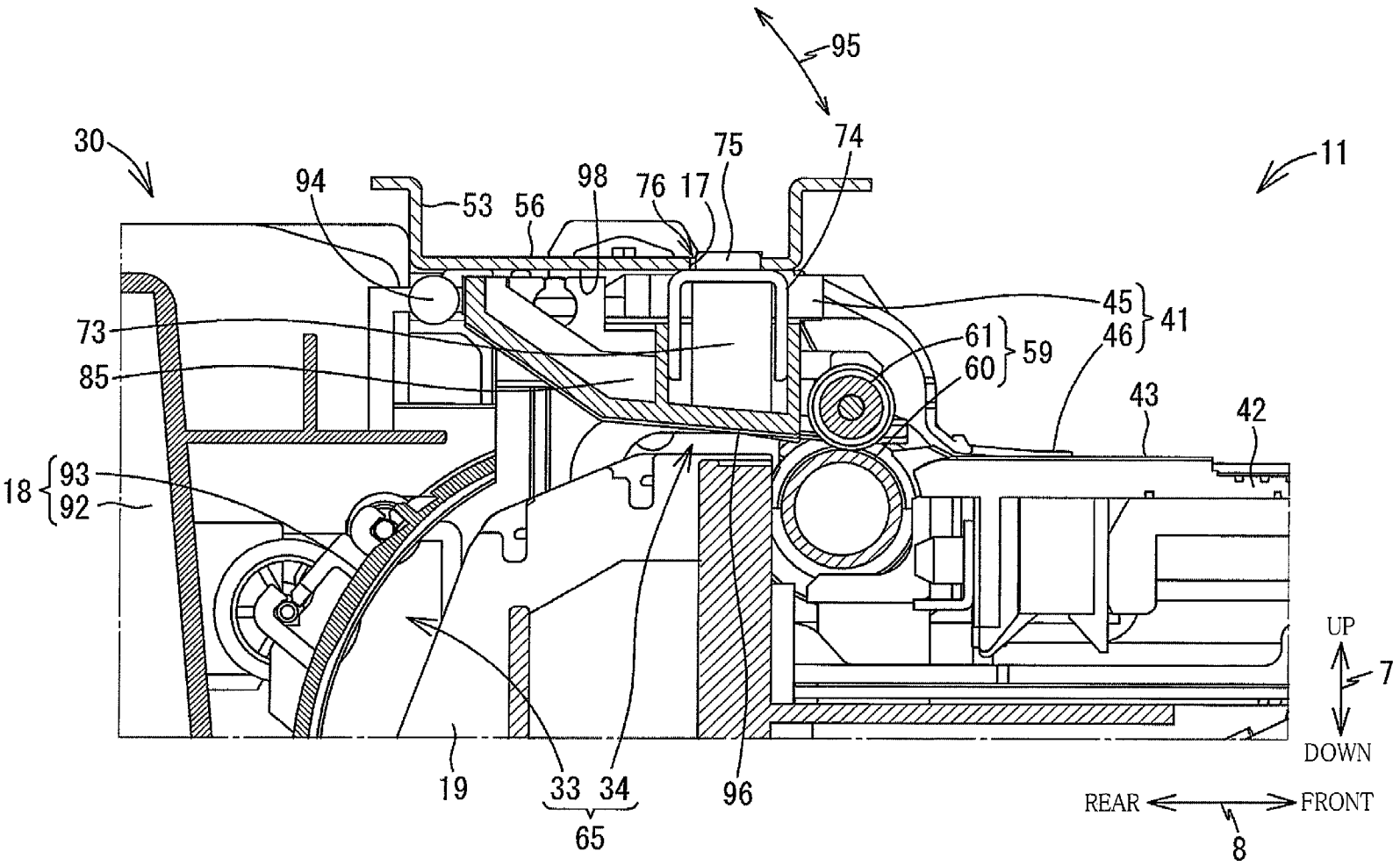
FIG. 3 is an enlarged view illustrating components around the roller holder in FIG. 2.

As illustrated in FIGS. 2 and 3, the contact members 41 are disposed on the conveyance path 65 on an upstream side of the recording device 24 in the conveying direction 15. The contact members 41 are spaced apart from each other in the right and left direction 9. Each of the contact members 41 is disposed between corresponding adjacent two of the ribs 43. Basal end portions 45 of the respective contact members 41 are located at a rear of the conveying roller pair 59 and supported by the roller holder 85. The contact members 41 extend while being curved downward and frontward from the respective basal end portions 45.

Each of the contact members 41 extends in the conveying direction 15 to a position located between the nozzles and the conveying roller pair 59. Distal end portions 46 of the respective contact members 41 are located below upper ends of the respective ribs 43. The distal end portions 46 contact an upper surface of the recording sheet being conveyed along the extending portion 34. The upper surface of the recording sheet is pressed by the distal end portions 46, and a lower surface of the recording sheet is pressed by the ribs 43, so that the shape of the recording sheet is changed to a shape of waves continuous in the right and left direction 9.

Conveying Roller Pair 59 and Output Roller Pair 44

As illustrated in FIGS. 2 and 3, the conveying roller pair 59 is disposed on the extending portion 34 at a position located upstream of the recording device 24 in the conveying direction 15. The output roller pair 44 is disposed on the extending portion 34 at a position located downstream of the recording device 24 in the conveying direction 15.

The conveying roller pair 59 includes: a conveying roller 60 (as one example of a first roller) disposed on a lower side of the extending portion 34; and pinch rollers 61 (each as one example of a second roller) disposed on an upper side of the extending portion 34 and opposed to the conveying roller 60. The conveying roller 60 is rotated, with the right and left direction 9 being as its axial direction. The pinch rollers 61 are spaced apart from each other in the right and left direction 9. Each of the pinch rollers 61 is rotated, with the right and left direction 9 being as its axial direction. Each of the pinch rollers 61 is pressed onto the conveying roller 60 respectively by coil springs 73.

The conveying roller 60 is rotatably supported in the housing 14 by a frame, not shown, of the MFP 10. The pinch rollers 61 are rotatably supported by the roller holder 85.

The output roller pair 44 includes: an output roller 62 disposed on a lower side of the extending portion 34; and spur rollers 63 disposed on an upper side of the extending portion 34 and opposed to the output roller 62. Each of the output roller 62 and the spur rollers 63 is rotated, with the right and left direction 9 being as their axial direction. The spur rollers 63 are pressed onto the output roller 62 respectively by resilient members, not shown. The output roller 62 is rotatably supported in the housing 14 by the frame, not shown, of the MFP 10. The spur rollers 63 are rotatably supported by the upper guide member 31.

The conveying roller 60 and the output roller 62 are rotated by a driving force generated by a motor, not shown. When the conveying roller 60 is rotated in a state in which the recording sheet is nipped by the conveying roller pair 59, the recording sheet is conveyed by the conveying roller pair 59 in the conveying direction 15 toward the platen 42. When the output roller 62 is rotated in a state in which the recording sheet is nipped by the output roller pair 44, the recording sheet is conveyed by the output roller pair 44 in the conveying direction 15 toward the output tray 21.

Guide Rails 56, 57

Each of the guide rails 56, 57 illustrated in FIG. 2 is generally shaped like a plate extending in the front and rear direction 8 and in the right and left direction 9. As illustrated in FIGS. 2 and 3, a rear end portion of the guide rail 56 is bent upward so as to form a rear bent portion 53. As illustrated in FIG. 2, the guide rails 56, 57 are spaced apart from each other in the front and rear direction 8, and the guide rail 57 is located in front of the guide rail 56. Front and rear end portions of the carriage 40 are respectively supported by the guide rails 56, 57.

A well-known belt mechanism, not shown, is disposed on an upper surface of the guide rail 57. The belt mechanism includes: pulleys respectively disposed on right and left end portions of the guide rail 57; and a belt looped over the pulleys. The belt is coupled to the carriage 40 and a carriage driving motor, not shown, for applying a driving force to the carriage 40. Upon driving of the carriage driving motor, the driving force is transmitted to the carriage 40 via the belt mechanism such that the carriage 40 is moved in the right and left direction 9. As a result, the carriage 40 is reciprocated in the right and left direction 9.

Guide Member 30

As illustrated in FIG. 2, a guide member 30 is disposed upstream of the recording device 24 in the conveying direction 15. The guide member 30 includes an outer guide member 18 and the roller holder 85. The outer guide member 18 is supported by the frame, not shown, of the MFP 10 so as to be pivotable, in a direction indicated by an arrow 91, about a shaft 90 (as one example of a first axis and a pivot shaft of the first guide member) which is provided upstream of the outer guide member 18 in the conveying direction 15 and extends in the right and left direction 9. With this construction, the guide member 30 is pivoted about an axis located at its upstream end portion in the conveying direction 15, such that a downstream end portion of the guide member 30 in the conveying direction 15 serves as a distal end during pivotal movement (noted that this distal end may be hereinafter referred to as "pivotal-movement distal end".

The outer guide member 18 is provided nearer to the shaft 90 than the roller holder 85, that is, the outer guide member 18 is provided upstream of the roller holder 85 in the conveying direction 15. The roller holder 85 is provided nearer to the pivotal-movement distal end of the guide member 30 than the outer guide member 18, that is, the roller holder 85 is provided downstream of the outer guide member 18 in the conveying direction 15.

An outer side (edge) of the curved portion 33 is defined by the outer guide member 18, the roller holder 85, and the inclined plate 23. It is noted that the outer side of the curved portion 33 may be defined only by the outer guide member 18 and the roller holder 85. In view of the above, the guide member 30 defines at least a portion of the outer side of the curved portion 33.

Outer Guide Member 18

As illustrated in FIG. 2, the outer guide member 18 can be pivoted or swung about the shaft 90 in the direction indicated by the arrow 91. In the lower or bottom portion of the housing 14, the shaft 90 protrudes outward from opposite ends of the outer guide member 18 in the right and left direction 9. The shaft 90 is supported by bearings, not shown, of the housing 14, so that the outer guide member 18 is pivotably supported by the housing 14. When the outer guide member 18 is located at a first position as illustrated in FIG. 2, the shaft 90 is located at a lower end portion (as one example of a first end) of the outer guide member 18, and when the outer guide member 18 is located at a second position as illustrated in FIG. 6, the shaft 90 is located at an end portion (as one example of the first end) of the outer guide member 18 which is nearer to the housing 14.

The outer guide member 18 includes: a side wall 92 partly constituting a rear surface of the housing 14; and a guide portion 93 disposed in front of the side wall 92 and supported by the side wall 92. The guide portion 93 is shaped like a plate curved at a portion thereof near the curved portion 33.

Figure 6:
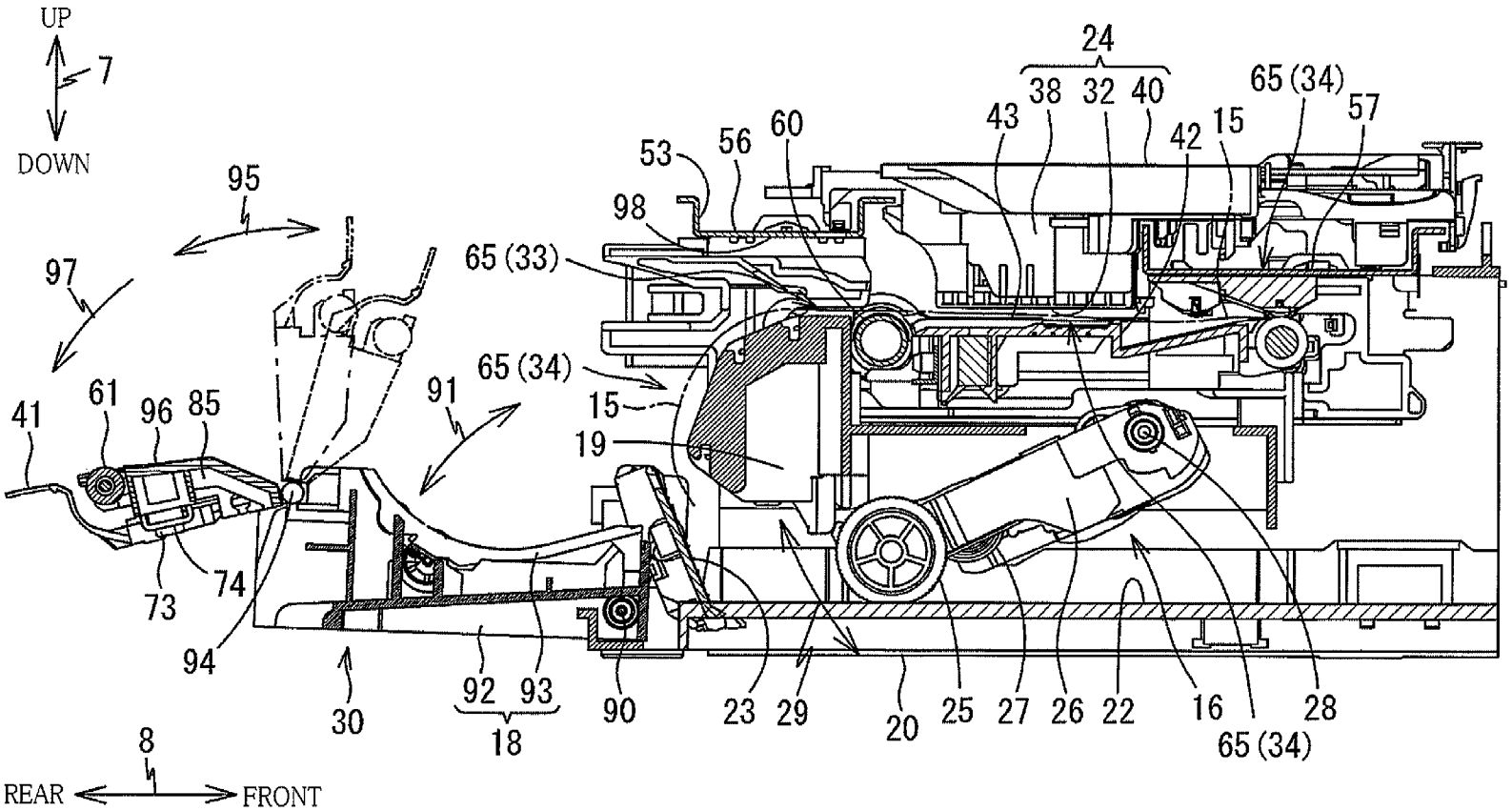
FIG. 6 is an elevational view in vertical cross section illustrating the internal structure of the printing unit, with the outer guide member located at the second position and the roller holder located at a fourth position.

The outer guide member 18 is pivoted between the first position illustrated in FIG. 2 and the second position illustrated in FIG. 6. When the outer guide member 18 is located at the first position, the guide portion 93 defines the outer side of the curved portion 33. When the outer guide member 18 is located at the second position, the curved portion 33 is exposed to an outside. A user of the MFP 10 can pivot the outer guide member 18 from the first position to the second position to remove a recording sheet jammed in the curved portion 33.

Roller Holder 85

As illustrated in FIGS. 2 and 3, the roller holder 85 is disposed under the guide rail 56. The roller holder 85 is elongated in the right and left direction 9. A front portion of the roller holder 85 supports the pinch rollers 61 such that the pinch rollers 61 are rotatable.

A rear end portion of the roller holder 85 is provided with a shaft 94 (as one example of a second axis) extending in the right and left direction 9. The shaft 94 is supported by the outer guide member 18, coupling the roller holder 85 to the outer guide member 18. It is noted that when the outer guide member 18 is located at the second position as illustrated in FIG. 6, the shaft 94 is located at an end portion (as one example of the second end) of the outer guide member 18 which is farther from the housing 14. That is, when the outer guide member 18 is located at the second position, the shaft 94 is located farther from the housing 14 than the shaft 90. The roller holder 85 is pivotable integrally with the outer guide member 18, with respect to the housing 14, in the direction indicated by the arrow 91. Also, as illustrated in FIG. 6, the roller holder 85 is pivotable about the shaft 94 with respect to the outer guide member 18 in a direction indicated by an arrow 95. It is noted that when a front end of the roller holder 85 is located in front of a rear end of the guide rail 56 (for example, when the outer guide member 18 is located at the first position), pivotal movement of the roller holder 85 about the shaft 94 is limited by the guide rail 56 (as one example of a first limiter).

The roller holder 85 is pivotable between a third position illustrated in FIG. 2 and a fourth position (as one example of a lower position) indicated by the solid lines in FIG. 6.

As illustrated in FIGS. 2 and 3, when the outer guide member 18 is located at the first position, the roller holder 85 is located at the third position. When the roller holder 85 is located at the third position, a rear portion of a lower surface 96 of the roller holder 85 defines the outer side of the curved portion 33, and a front portion of the lower surface 96 of the roller holder 85 defines an upper side of the extending portion 34. When the roller holder 85 is located at the third position, the pinch rollers 61 face the conveying roller 60 and are held in contact with the conveying roller 60 from an upper side thereof.

In the state in which the pinch rollers 61 and the conveying roller 60 are held in contact with each other, the shaft of the pinch rollers 61 is located in front of the shaft of the conveying roller 60. Consequently, the recording sheet nipped by the conveying roller pair 59 is conveyed obliquely downward in the front direction and pressed onto the platen 42. This construction can fix a distance between the recording head 38 and the recording sheet supported by the platen 42.

As illustrated in FIG. 6, when the outer guide member 18 is located at the second position, the roller holder 85 is pivotable between a fifth position (as one example of an upper position) indicated by the broken lines and the fourth position indicated by the solid lines. A position of the roller holder 85 located at the fifth position relative to the outer guide member 18 is located slightly in front of a position of the roller holder 85 located at the third position relative to the outer guide member 18 (i.e., the position indicated by the one-dot chain lines in FIG. 6). It is noted that pivotal movement of the roller holder 85 to a front side of the fifth position is limited by a stopper, not shown, provided on the outer guide member 18. The roller holder 85 is pivoted from the third position or the fifth position in a direction indicated by an arrow 97 and positioned at a rear of the outer guide member 18 located at the second position. In this state, the roller holder 85 is located at the fourth position, and the roller holder 85 located at the fourth position extends in a direction away from the curved portion 33 defined by the outer guide member 18. Also, the fourth position of the roller holder 85 is located below the fifth position of the roller holder 85. More specifically, an upper end of the roller holder 85 located at the fourth position is below the upper end of the roller holder 85 located at the fifth position.

As illustrated in FIGS. 2 and 3, when the outer guide member 18 is located at the first position, the guide rail 56 (as one example of an upper wall) is disposed over the roller holder 85 in the housing 14. Since the guide rail 56 is fixed to the frame, not shown, of the MFP 10 in the housing 14, the guide rail 56 is not pivoted together with the outer guide member 18. It is noted that the upper wall is not limited to the guide rail 56 as long as the upper wall covers an upper side of the roller holder 85 when the outer guide member 18 is located at the first position.

Coil Springs 73 and Engagement Members 74

As illustrated in FIGS. 2 and 3, pairs of the coil springs 73 and engagement members 74 are provided on the roller holder 85. The pairs of the coil springs 73 and the engagement members 74 are spaced apart from each other in the right and left direction 9. Each of the coil springs 73 is supported by the roller holder 85, and each of the engagement members 74 is supported by the corresponding one of the coil springs 73. The coil springs 73 are interposed between the roller holder 85 and the respective engagement members 74.

Lower end portions of the respective coil springs 73 are held in contact with the roller holder 85, and upper end portions of the respective coil springs 73 are held in contact with the respective engagement members 74. Lower surfaces of the respective engagement members 74 are respectively held in contact with the upper end portions of the respective coil springs 73. Upper surfaces of the respective engagement members 74 (each as one example of a second limiter) are held in contact with a lower surface 98 (as one example of the first limiter) of the guide rail 56. Projections 75 (each as one example of the second limiter) are formed on the upper surfaces of the respective engagement members 74. The guide rail 56 has openings 76 (each as one example of the first limiter) at positions corresponding to the respective engagement members 74. It is noted that the following explanation is provided for one of the coil springs 73 and one of the contact members 41 for simplicity unless otherwise required by context.

When the outer guide member 18 is located at the first position, and the roller holder 85 is located at the third position, the projection 75 is urged upward by the coil spring 73 and fitted in the opening 76. As a result, the engagement member 74 and the guide rail 56 are engaged with each other. This engagement limits the pivotal movement of the roller holder 85 about the shaft 94 with respect to the outer guide member 18. That is, the engagement member 74 and the guide rail 56 cooperate to serve as a pivotal-movement limiter configured to limit the pivotal movement of the roller holder 85 about the shaft 94 with respect to the outer guide member 18. In this state, the coil spring 73 is compressed and has a length shorter than its natural length. Thus, the coil spring 73 urges the pinch roller 61 toward the conveying roller 60. As a result, the pinch roller 61 is pressed onto the conveying roller 60.

In the present embodiment, the coil spring 73 is used for urging the projection 75 upward and urging the pinch roller 61 toward the conveying roller 60. However, an urging member for urging the projection 75 upward and an urging member for urging the pinch roller 61 toward the conveying roller 60 may be independent of each other.

Pivotal Movement of Guide Member 30

There will be next explained pivotal movement of the guide member 30. As illustrated in FIGS. 2 and 3, when the outer guide member 18 is located at the first position, the roller holder 85 is located at the third position. In this state, the engagement member 74 is fitted in the opening 76 of the guide rail 56, whereby the roller holder 85 is positioned at the third position. That is, the pivotal movement of the roller holder 85 about the shaft 94 with respect to the outer guide member 18 is limited. When the roller holder 85 is located at the third position, the distal end portion 46 of the contact member 41 is located below a position at which the conveying roller pair 59 nips the recording sheet. When the roller holder 85 is located at the third position, the pinch roller 61 is held in contact with the conveying roller 60 by an urging force of the coil spring 73.

When the outer guide member 18 is pivoted from the first position to the second position in the direction indicated by the arrow 91, the roller holder 85 is pivoted rearward integrally and together with the outer guide member 18. Consequently, the projection 75 of the engagement member 74 is held in pressing contact with a rear side surface 17 of the opening 76. As a result, the projection 75 receives a force of reaction from the rear side surface 17. The force of the reaction compresses the coil spring 73, which moves the engagement member 74 downward. As a result, as illustrated in FIG. 4, the projection 75 comes out of the opening 76, which releases the engagement of the engagement member 74 and the guide rail 56.

When the outer guide member 18 is pivoted further toward the second position, the projection 75 is moved rearward along the lower surface 98 of the guide rail 56 by the urging force of the coil spring 73 in a state in which the projection 75 is held in contact with the lower surface 98. When the projection 75 is moved to a position located at a rear of the lower surface 98, the compressed coil spring 73 returns to its natural length.

Figure 4:
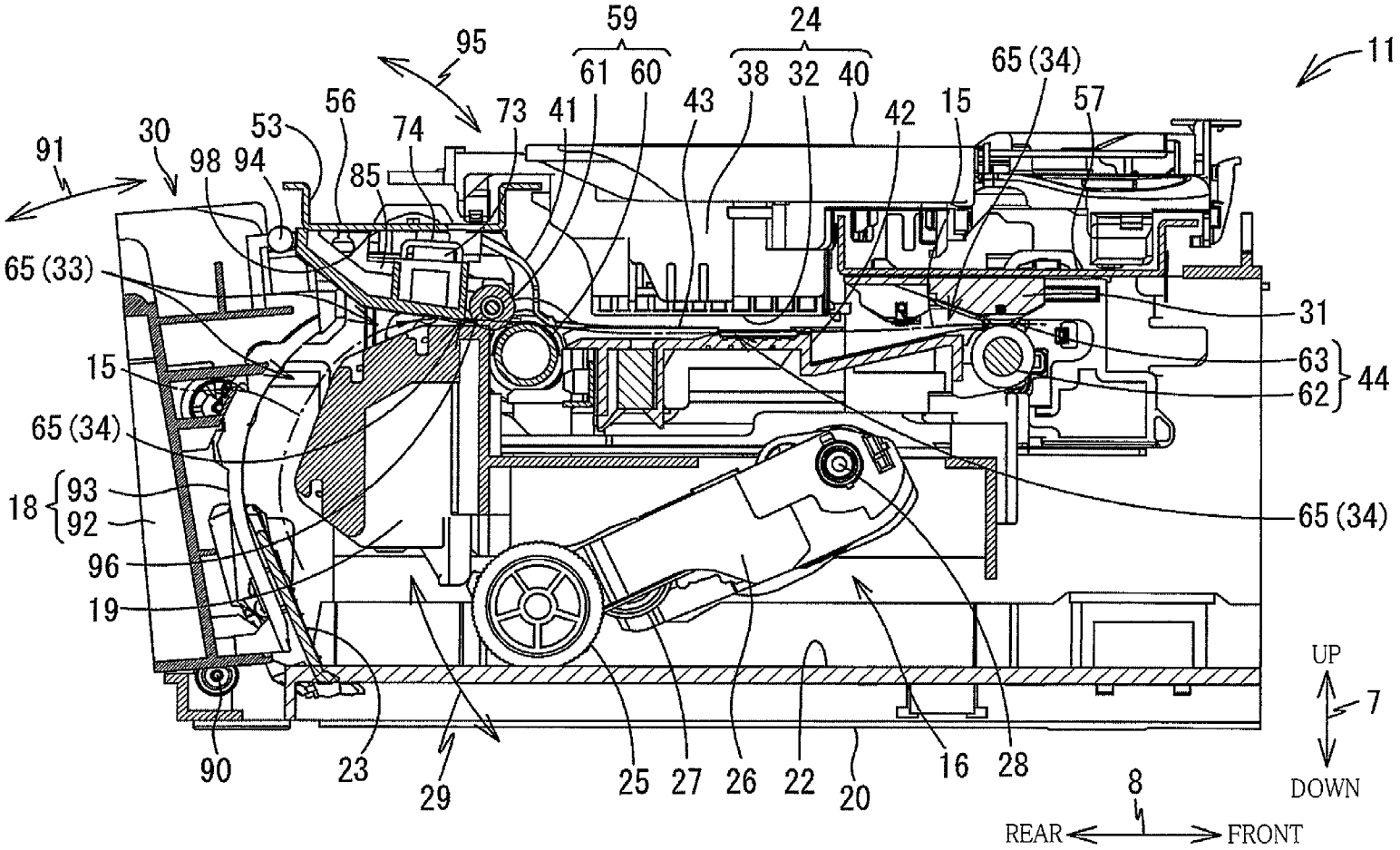
FIG. 4 is an elevational view in vertical cross section illustrating the internal structure of the printing unit when the outer guide member is located nearer to a second position than the position of the outer guide member illustrated in FIG. 2.

In the state illustrated in FIG. 4, the lower surface 96 of the roller holder 85 is supported by the inner guide member 19. The roller holder 85 is guided rearward along a surface of the extending portion 34 which is nearer to the inner guide member 19. The contact member 41 and the pinch roller 61 are also guided rearward integrally with the roller holder 85. As a result, the pinch roller 61 is moved off the conveying roller 60.

Figure 5:
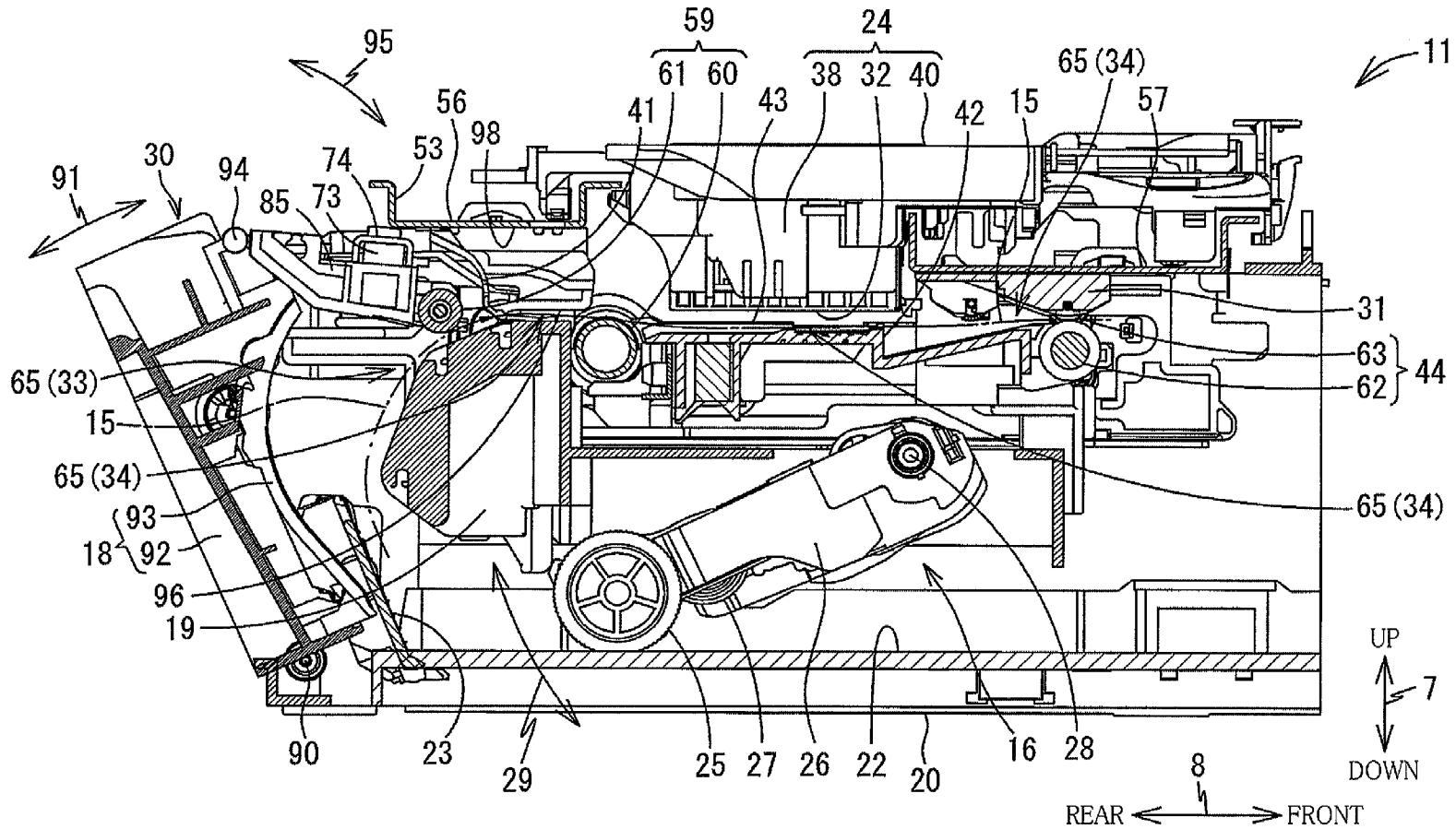
FIG. 5 is an elevational view in vertical cross section illustrating the internal structure of the printing unit when the outer guide member is located nearer to a second position than the position of the outer guide member illustrated in FIG. 4.

The lower surface 96 of the roller holder 85 guided rearward is moved off the surface of the extending portion 34 which is nearer to the inner guide member 19 and supported by a surface of the inner guide member 19 nearer to the curved portion 33. Here, the surface of the inner guide member 19 nearer to the curved portion 33 is curved obliquely downward in the rear direction. Accordingly, the roller holder 85 is pivoted downward by its own weight in accordance with the guided movement of the roller holder 85 rearward. This pivotal movement is limited by the above-described stopper. With this limitation, when the roller holder 85 is moved rearward from a particular position, the roller holder 85 comes off the inner guide member 19 (see FIG. 5).

By being further pivoted toward the second position, the outer guide member 18 reaches the second position (see FIG. 6). In this state, the roller holder 85 is located at the fifth position indicated by the broken lines in FIG. 6, the pinch roller 61 is spaced apart from the conveying roller 60, and the contact member 41 is spaced apart from the conveyance path 65. In this state, the roller holder 85 is pivotable, toward the fourth position indicated by the solid lines in FIG. 6, in the direction indicated by the arrow 97.

When the outer guide member 18 is pivoted to the first position in a state in which the outer guide member 18 is located at the second position, and the roller holder 85 is located at the fourth position (see FIG. 6), the roller holder 85 is first pivoted from the fourth position to the fifth position in a direction reverse to the direction indicated by the arrow 97.

When the outer guide member 18 is then pivoted toward the first position in the direction indicated by the arrow 91, the projection 75 is brought into pressing contact with the rear bent portion 53 of the guide rail 56. Consequently, the projection 75 receives a force of reaction from the rear bent portion 53. This force of the reaction compresses the coil spring 73, thereby moving the engagement member 74 downward, so that the projection 75 is brought into contact with the lower surface 98 of the guide rail 56 (see FIG. 5). As a result, the engagement member 74 is moved into the housing 14 from a position located between the guide rail 56 and the inner guide member 19.

When the roller holder 85 is moved to a position in front of the particular position, the lower surface 96 of the roller holder 85 is brought into contact with the inner guide member 19. The roller holder 85 is thereafter guided along the surface of the inner guide member 19 nearer to the conveyance path 65 (see FIG. 4).

When the outer guide member 18 is further pivoted toward the first position in the direction indicated by the arrow 91, as illustrated in FIG. 2, the outer guide member 18 reaches the first position. In this state, the projection 75 is fitted in the opening 76 of the guide rail 56, and the roller holder 85 is located at the third position. When the roller holder 85 is located at the third position, the pinch roller 61 is held in contact with the conveying roller 60, and the contact member 41 can contact an upper surface of the recording sheet being conveyed in the conveying direction 15.

In the above-described embodiment, the roller holder 85 is one example of the second guide member, but the second guide member is not limited to the roller holder 85. For example, as illustrated in FIG. 7, the second guide member may be a guide member 86 provided downstream of the outer guide member 18 in the conveying direction 15.

Figure 7:
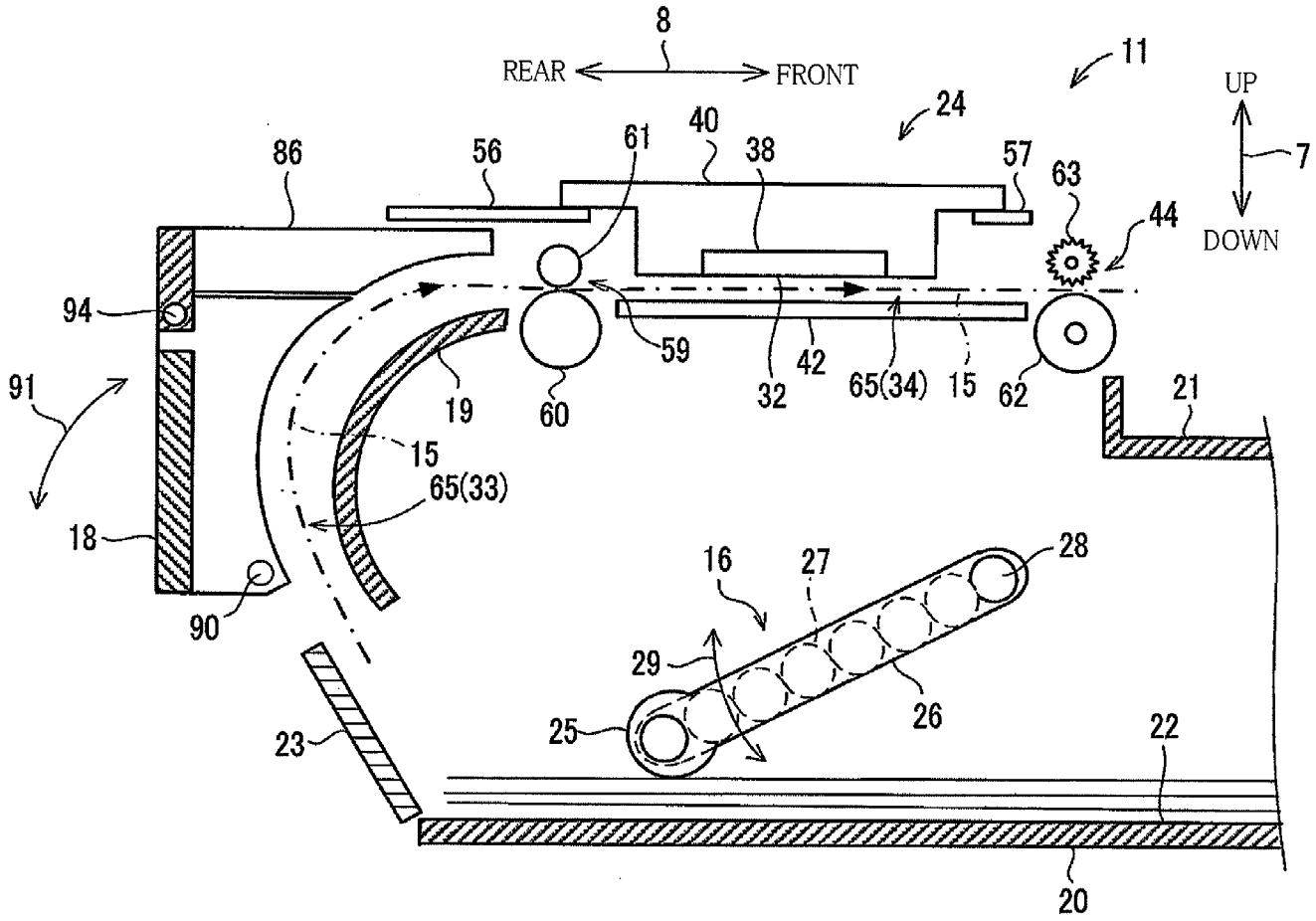
FIG. 7 is an elevational view in vertical cross section schematically illustrating the internal structure of the printing unit including a guide member, with the outer guide member located at the first position.
Figure 8:
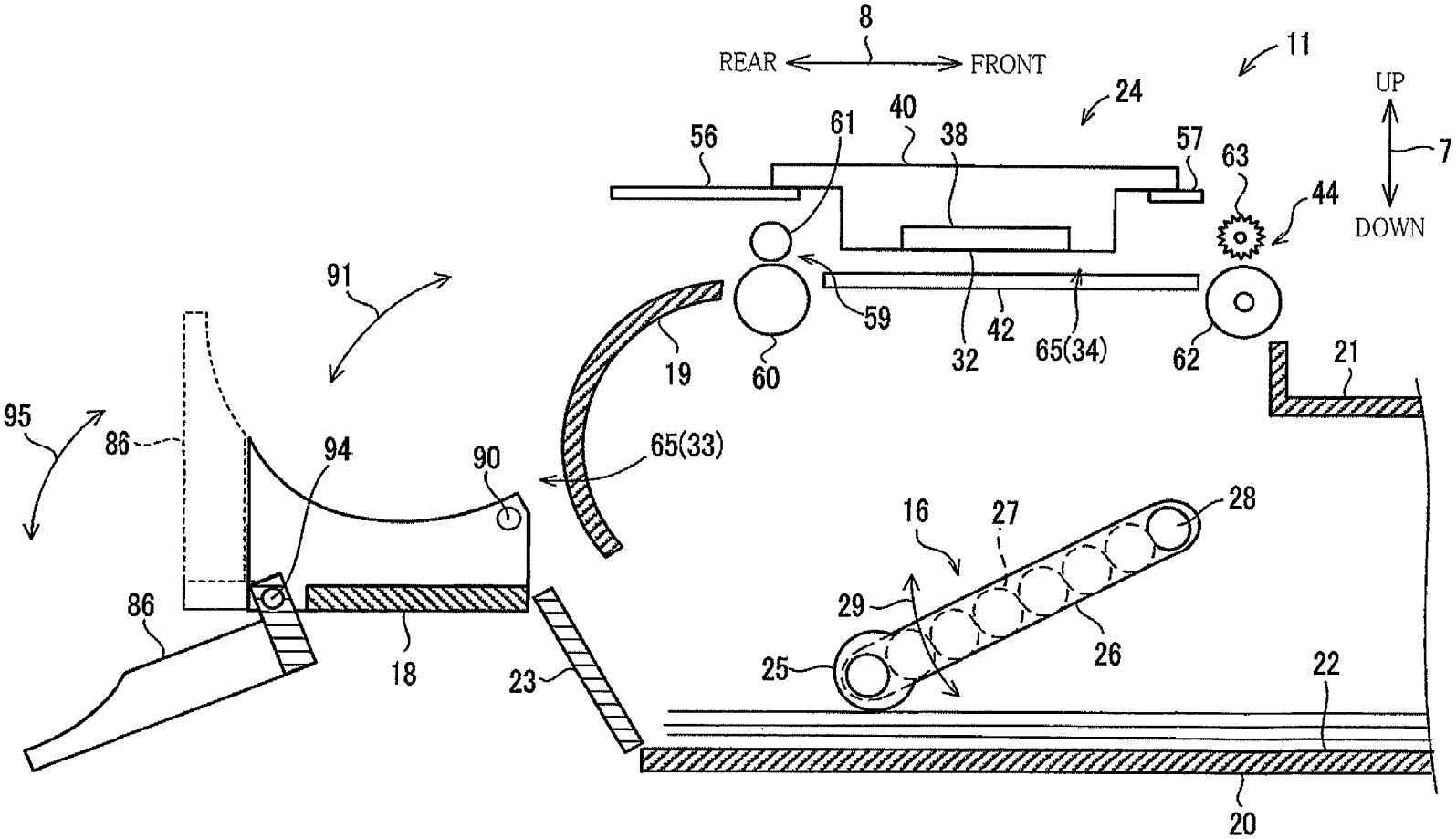
FIG. 8 is an elevational view in vertical cross section schematically illustrating the internal structure of the printing unit including the guide member, with the outer guide member located at the second position.

Like the roller holder 85, when the outer guide member 18 is located at the first position illustrated in FIG. 7, the guide member 86 partly defines the curved portion 33 and the extending portion 34. The guide member 86 differs from the roller holder 85 in that the guide member 86 does not support the pinch roller 61 or the contact member 41. It is noted that illustration of the contact member 41 is omitted in FIGS. 7 and 8.

Like the roller holder 85, the shaft 94 provided on a rear end portion of the guide member 86 is supported by the outer guide member 18, whereby the guide member 86 is coupled to the outer guide member 18. With this construction, when the outer guide member 18 is located at the second position illustrated in FIG. 8, the guide member 86 is pivotable about the shaft 94 in the direction indicated by the arrow 95. It is noted that as illustrated in FIG. 7, when the outer guide member 18 is located at the first position, the guide rail 56 exists over the guide member 86, whereby pivotal movement of the guide member 86 is limited by the guide rail 56.

Effects

In the present embodiment, when the outer guide member 18 is located at the first position, and the roller holder 85 is located at the third position, the conveyance path 65 continuous from a sheet-supply position to the recording device 24 is defined or covered. When the outer guide member 18 is located at the second position, the curved portion 33 of the conveyance path 65 is opened and exposed. When the roller holder 85 is located at the fourth position, the roller holder 85 extends in a direction away from the portion of the outer guide member 18 which defines the curved portion 33, so that a space near the pivotal-movement distal end of the outer guide member 18 is widely open. Also, the roller holder 85 is moved downward by its pivotal movement from the third position to the fourth position. This construction allows the user to easily access the opened conveyance path 65.

In the present embodiment, when the outer guide member 18 is located at the second position, the curved portion 33 of the conveyance path 65 is opened and exposed, and the nip of conveying roller 60 and the pinch roller 61 is released.

In the present embodiment, since the curved portion 33 extends upward from the supply tray 20, a portion of the conveyance path 65 from the supply tray 20 to the recording device 24 can be opened by the outer guide member 18 and the roller holder 85.

In the present embodiment, even in the case where the supply tray 20 is disposed under the housing 14, and thereby the outer guide member 18 cannot be pivoted downward from the lower side of the housing 14, a most portion of the conveyance path 65 is widely open when the roller holder 85 is located at the fourth position.

In the present embodiment, the outer guide member 18 has the side wall 92 of the housing 14. Accordingly, when the outer guide member 18 is located at the second position, the user can access the conveyance path 65 from a side of the housing 14 which is nearer to the side wall 92.

In the present embodiment, the user can access the conveyance path 65 from a side nearer to the side wall 92 even in a construction in which the upper wall of the housing 14 which covers an area over the roller holder 85 does not expose a space over the roller holder 85. Also, when the outer guide member 18 is located at the first position, pivotal movement of the roller holder 85 to positions other than the third position is limited, allowing the roller holder 85 to appropriately define the conveyance path 65.

In the present embodiment, when the outer guide member 18 is located at the second position, the curved portion 33 of the conveyance path 65 is opened, and the contact member 41 is spaced apart from the conveyance path 65.

What is claimed is:

1. An image recording apparatus, comprising:

a housing formed with a conveyance path comprising (i) a curved portion curved upward and (ii) an extending portion continuous to the curved portion;

a recording device configured to record an image on a sheet conveyed in a conveying direction along the extending portion of the conveyance path; and a guide member disposed on the conveyance path at a position located upstream of the recording device in the conveying direction, the guide member defining at least a portion of an outer side of the curved portion of the conveyance path, the guide member being pivotable in a state in which an upstream end portion of the guide member in the conveying direction serves as an axis, and a downstream end portion of the guide member in the conveying direction serves as a pivotal-movement distal end, the guide member comprising a first guide portion and a second guide portion, the first guide portion being nearer to the axis than the second guide portion, the second guide portion being nearer to the pivotal-movement distal end than the first guide portion, the first guide portion being pivotable between (i) a first position at which the first guide portion defines a portion of the curved portion and (ii) a second position at which the curved portion is open, the second guide portion being pivotably coupled to the first guide portion and movable between (i) a third position at which the second guide portion defines a portion of the curved portion when the first guide portion is located at the first position and (ii) a fourth position at which when the first guide portion is located at the second position, the second guide portion extends in a direction directed from an inner side to the outer side of the curved portion defined by the first guide portion.

2. The image recording apparatus according to claim 1, wherein the second guide portion defines at least a portion of the extending portion and the curved portion.

3. The image recording apparatus according to claim 1, further comprising: a first roller disposed on the conveyance path at a position located upstream of the recording device in the conveying direction; and a second roller which is opposed to the first roller, wherein the first roller is supported in the housing, wherein the second roller is supported by the second guide portion, wherein the second roller is opposed to the first roller when the first guide portion is located at the first position, and the second guide portion is located at the third position, and wherein the second roller is spaced apart from the first roller and not opposed to the first roller when the first guide portion is located at the second position.

4. The image recording apparatus according to claim 1, further comprising: a tray configured to support the sheet; and a supply device configured to supply the sheet from the tray along the conveyance path, wherein the curved portion extends upward from the tray.

5. The image recording apparatus according to claim 1, wherein the tray is disposed in a bottom portion of the housing, and wherein the axis of the first guide portion is located in the bottom portion of the housing.

6. The image recording apparatus according to claim 1, wherein the first guide portion comprises a side wall of the housing.

7. The image recording apparatus according to claim 6, wherein the housing comprises an upper wall covering an upper side of the second guide portion, and wherein the upper wall is not pivoted with the first guide portion.

8. The image recording apparatus according to claim 1, further comprising a contact member disposed on the conveyance path at a position located upstream of the recording device in the conveying direction, the contact member being contactable with the sheet conveyed along the conveyance path, wherein the contact member is supported by the second guide portion, wherein the contact member is configured to contact the sheet conveyed along the conveyance path, when the second guide portion is located at the third position, and wherein the contact member is spaced apart from the conveyance path when the second guide portion is located at the fourth position.

9. An image recording apparatus, comprising:

a housing formed with a conveyance path comprising (i) a curved portion curved upward and (ii) an extending portion continuous to the curved portion;

a recording device configured to record an image on a sheet conveyed in a conveying direction along the extending portion of the conveyance path; and a guide member disposed on the conveyance path at a position located upstream of the recording device in the conveying direction, the guide member defining at least a portion of an outer side of the curved portion of the conveyance path, the guide member comprising: a first guide portion pivotable about a first axis relative to the housing; and a second guide portion pivotable about a second axis relative to the first guide portion, the first guide portion being pivotable between (i) a first position at which the first guide portion defines a portion of the curved portion and (ii) a second position at which the curved portion is open, the second guide portion being pivotable between an upper position and a lower position located on a lower side of the upper position, when the first guide portion is located at the second position.

10. The image recording apparatus according to claim 9, wherein an upper end of the second guide portion when the second guide portion is located at the lower position is lower in height position than the upper end of the second guide portion when the second guide portion is located at the upper position.

11. The image recording apparatus according to claim 9, wherein the first axis is located at a first end portion of the first guide portion, and wherein the second axis is located at a second end portion of the first guide portion.

12. The image recording apparatus according to claim 9, wherein the second axis is located farther from the housing than the first axis when the first guide portion is located at the second position.

13. The image recording apparatus according to claim 9, further comprising a pivotal-movement limiter configured to limit pivotal movement of the second guide portion about the second axis with respect to the first guide portion when the first guide portion is located at the first position.

14. The image recording apparatus according to claim 13, further comprising a frame disposed in the housing, wherein the pivotal-movement limiter comprises: a first limiter supported by the frame; and a second limiter supported by the second guide portion, and wherein the second limiter is configured to contact the first limiter to limit the pivotal movement of the second guide portion.

* * * * *